United States Patent [19]

Kaulich

[11] Patent Number: 4,683,164

[45] Date of Patent: Jul. 28, 1987

[54] NONWOVEN FOR MANUFACTURING FLAMEPROOF ROOFING SHEETS

[75] Inventor: Franz Kaulich, Bobingen, Fed. Rep. of Germany

[73] Assignee: Hoechst Aktiengesellschaft, Fed. Rep. of Germany

[21] Appl. No.: 734,787

[22] Filed: May 16, 1985

[30] Foreign Application Priority Data

May 19, 1984 [DE] Fed. Rep. of Germany ..... 3418790

[51] Int. Cl.[4] ..... B32B 27/34

[52] U.S. Cl. ..... 428/287; 428/290; 428/489; 428/920; 428/921

[58] Field of Search ..... 428/287, 290, 920, 921, 428/291, 489

[56] References Cited

U.S. PATENT DOCUMENTS 3,816,226 6/1974 Finelli ..... 428/280

*Primary Examiner*—James J. Bell

*Attorney, Agent, or Firm*—Connolly and Hutz

[57] ABSTRACT

The invention relates to a nonwoven made of synthetic fibers or filaments for preparing roofing sheets by coating with fusible coating compositions. A nonwoven of this type is provided with a flame-retardant finish which is still inert at the processing temperatures of the coating composition (for example up to about 250° C.) but which at higher temperatures forms a largely continuous, preferably foamlike, layer which in the event of a fire preferably remains in place even if the supporting fibers or filaments of the nonwoven melt away.

4 Claims, No Drawings

NONWOVEN FOR MANUFACTURING FLAMEPROOF ROOFING SHEETS

The present invention relates to a nonwoven which is preferably made of polyester filaments and is suitable for use in roofing sheets which are resistant to jump fire and radiant heat. These roofing sheets are usually provided with a bitumen coating, but can also have a coating made from elastomers or plastomers.

Carriers of this type for roofing sheets are known per se from German Patent No. 2,827,136. They comprise a nonwoven which is made for example of polyester filaments and attached thereto at points, for example by needles, a metal foil, for example a folded aluminum foil. In the event of a local jump fire a metal foil of this type stays behind as an undamaged layer and thereby prevents the spread of the fire into the lower layers of any roof seal. It is true that the cited layer material made of a nonwoven and a metal foil is very effective against jump fire and radiant heat, but it is very expensive to manufacture.

It has already been proposed to produce nonwovens from flame-retardant fiber raw materials. However, the use of such fiber and filament raw materials in the production of the required nonwovens did not lead to the desired success: use of the technique was unable to prevent the fire from spreading into the lower layers of a roof cover. Nor were flame-retardant additives to the bitumen material or polymer material successful. In the event of a fire the flame-retardant additives flowed away together with the bitumen, so that the nonwoven remaining behind and the lower layers are no longer protected by these additives.

The application of flame-retardant additives to the surface of such roofing sheets has the additional disadvantage that the flame-retardant materials are constantly exposed to the effects of the weather.

German Offenlegungsschrift No. 2,655,038 describes a process for preparing low-flammability bitumen corrugated boards. In said process, the raw board used for this purpose is to be impregnated with an aqueous solution of a mixture of various flame-retarders. The board thus impregnated is shaped and dried and is then impregnated with bitumen. The use of such a mixture with a nonwoven likewise does not lead to the desired success. There are in addition processing problems which are due, inter alia, to the significantly lower absorbency and swellability of the nonwoven used and to the significantly higher flexibility of the nonwoven in use as a reinforcing material.

The present invention therefore has for its object to find a nonwoven which is made of synthetic filaments and/or fibers, for example polyester filaments or fibers, and which is suitable for preparing coated roofing sheets which are resistant to jump fire and radiant heat.

It has now been found, surprisingly, that the stated requirements are met by nonwovens made of synthetic fibers and/or filaments when, in accordance with the present invention, they are finished before the coating with a fireproofing agent which is inert at temperatures up to markedly above the melting point of the coating material but at higher temperatures forms a largley continuous layer on the nonwoven. The continuous layer which forms should preferably have a foamlike character. If the nonwoven is coated with bitumen, the fireproofing agent required according to the invention should be inert at least up to temperatures of about 220°

C., preferably 250° C. or even 300° C. but at slightly higher temperatures then form a largely continuous layer.

These flame-retardant finishes can be applied to the nonwoven directly when as the nonwoven is being formed or at the same time with binders and other finishing agents. This type of combination makes it possible to integrate this finishing step into the normal process for producing nonwovens and requires no further process steps and no additional apparatus for its preparation. However, if desired the finishes can also be applied by methods known per se, such as, for example, passing through a coating bath, padding or spraying, for example in the form of aqueous dispersions, immediately before the actual bitumening, provided care is taken to ensure that the dispersant is largely removed again before the actual coating.

Of the large number of known flame-retardant agents or fire-quenching agents whose action relies on the formation of a continuous, possibly foamlike, layer, preference should be given to the use of those products which in the course of the coating of the nonwoven, that is to say for example in the course of the bitumening, and obviously also in the course of laying the roofing sheets, that is to say for example in the course of welding the individual sheets or in the course of flame treatment during the laying do not produce changes to the roofing sheet thus finished. On the other hand, preferably when the melting point of the fiber material used in the nonwoven is exceeded the flame-retardant material should undergo a reaction which ensures the formation of a continuous skin or layer even if the filaments in the nonwoven melt away. If this condition is not met, there is a danger that the flame-retardant additive will melt away together with the molten polymer material comprising the nonwoven and is no longer able to exert adequate protective action in respect of the lower layers.

If the flame-retardant agents used are of the type which do not produce such crusting or sintering in the vicinity of the melting point of the polymer material comprising the nonwoven, it is necessary to ensure through the addition of suitable compounds, if desired resins and the like, that the flame-retardant material will remain fixed in the intended place in the event of a fire.

The melting of the nonwoven in the roofing sheets constitutes a considerable difference from the bitumen corrugated boards described in German Offenlegungsschrift No. 2,655,038, where stiffening is due to nonmelting board which tends to carbonize. For that reason, in said citation it is evidently also possible to make use of fireproofing agents which have the effect of "blowing out" the flames by means of inert gases and/or of quenching the fire through free-radical capture. This type of agent is not suitable for use as a flame-retardant additive in the case of nonwoven-reinforced roofing sheets, since, once the filament material making up the nonwoven has melted away, they are no longer able to exert their action in the desired area.

In the event of a fire the invention envisages the formation at high temperatures of a covering, preferably foamlike, layer which cannot flow off as a result of nonwoven layers which may flow away, but which like the state of the art metal foil prevents the fire from spreading into the lower nonwoven layers and bitumen layers and into the further roof structure.

I claim:

1. A nonwoven for manufacturing flameproof roofing sheets comprising a fleece of meltable synthetic fibers or filaments finished with a formulation which, at temperatures above 220° C., reacts to form a fire resistant, foam-like, substantially continuous layer.

2. A nonwoven according to claim 1, wherein the formulation reacts at a temperature below the melting temperature of the synthetic fibers.

3. A nonwoven according to claim 1, wherein the formulation reacts at a temperature between 250° and 300° C.

4. A nonwoven according to claim 1, wherein the synthetic fibers or filaments are of spinnable polyester.

* * * * *